US009010987B2

(12) United States Patent
Sherman et al.

(10) Patent No.: US 9,010,987 B2
(45) Date of Patent: Apr. 21, 2015

(54) METHOD AND AN APPARATUS/UNIVERSAL COMBINE FOR AGITATION OF LIQUIDS

(76) Inventors: Yury Sherman, Roslindale, MA (US); Michael Sherman, Newton, MA (US); Ilya Alexandrov, Newton, MA (US); Ramkumur Krishnan, Watertown, MA (US)

( * ) Notice: Subject to any disclaimer, the term of this patent is extended or adjusted under 35 U.S.C. 154(b) by 319 days.

(21) Appl. No.: 13/374,939

(22) Filed: Jan. 25, 2012

(65) Prior Publication Data

US 2013/0188442 A1 Jul. 25, 2013

(51) Int. Cl.
*B01F 9/10* (2006.01)

(52) U.S. Cl.
CPC ..... *B01F 9/10* (2013.01)

(58) Field of Classification Search
CPC ..... B01F 2009/0092; B01F 9/103; B01F 9/10
USPC ..... 366/213, 228, 56, 57, 226; 68/24, 133, 68/232, 233
See application file for complete search history.

(56) References Cited

U.S. PATENT DOCUMENTS

| | | | | | |
|---|---|---|---|---|---|
| 112,603 | A * | 3/1871 | King | 74/42 |
| 1,405,733 | A * | 2/1922 | Mahler | 366/226 |
| 1,696,718 | A * | 12/1928 | Kuhlmann et al. | 68/23.7 |
| 1,756,318 | A * | 4/1930 | Voss | 68/133 |
| 1,854,745 | A * | 4/1932 | Keltie | 68/133 |
| 2,219,680 | A * | 10/1940 | Pendleton | 68/23.7 |
| 2,575,691 | A * | 11/1951 | Smith | 68/23.7 |
| 2,808,241 | A * | 10/1957 | Beran, Jr. | 366/57 |
| 3,430,927 | A * | 3/1969 | Pouzar | 366/213 |
| 3,595,623 | A * | 7/1971 | Sperti | 422/270 |
| 4,127,015 | A * | 11/1978 | Platt et al. | 68/133 |
| 4,237,154 | A * | 12/1980 | Garrison | 427/241 |
| 4,664,527 | A * | 5/1987 | Schuler | 366/141 |
| 5,297,403 | A * | 3/1994 | Farrington et al. | 68/23.3 |
| 5,823,019 | A * | 10/1998 | Park | 68/133 |
| 7,168,846 | B1 * | 1/2007 | Maupin | 366/226 |
| 8,336,341 | B2 * | 12/2012 | Kim et al. | 68/140 |
| 2007/0044520 | A1 * | 3/2007 | Kopyrin et al. | 68/131 |
| 2009/0211311 | A1 * | 8/2009 | McMaster et al. | 68/133 |

* cited by examiner

*Primary Examiner* — David Sorkin
*Assistant Examiner* — Abbas Rashid
(74) *Attorney, Agent, or Firm* — Bold IP, PLLC; John Houvener

(57) ABSTRACT

A method of mixing together liquids or liquid/solid combinations, and mixing apparatus/universal combine utilizing a vertical spinning container or vessel having a rib, or a cross rib in its bottom wall. The container is spun about a vertical axis with no wobbling component to the motion. Meshed elements are used for high shear mixing. Start/stop routines, and variable acceleration/speed values are used, to facilitate complete mixing. Use of 'impeller' blade stirrers is completely eliminated.

20 Claims, 8 Drawing Sheets

Fg - Gravitational force
Fc - Centrifugal force
- Vertical circulation
- Direction of tank rotation
H - Level of liquid

METHOD AND AN APPARATUS/UNIVERSAL COMBINE FOR AGITATION OF LIQUIDS

Research and development of the present invention and application have not been Federally-sponsored, and no rights are given under any Federal program.

FIELD OF THE INVENTION

This invention relates to a method of agitation and mixing various liquid substances, dissolving solids in liquid, making emulsions, extracts, milling solids in presence of liquids and more.

BACKGROUND ART

The main characteristic of currently known methods of agitation of liquids is that the liquid to be mixed is moved inside a stationary installed container. Friction forces between the liquids and wall of the container breaks the liquid's movement. The higher speed of movement of the liquids, the stronger the breaking force. Most of the existing mixers are specialized at performance within rather narrow range of characteristics: mixing of low viscosity liquids, mixing of high viscosity liquids, making emulsions or extracts, milling solids in liquids etc. There is no universal apparatus for a variety of mixing processes.

Typical drawbacks of prior art mixers are:

- mixing is not always complete, or more often extended time is required in order to obtain a resultant homogeneous mixture.
- in many cases, undesirable aeration takes place as a consequence of air being introduced into the liquid. Bubbles of air result, and these represent either un-mixed material, or alternately, material that has been mixed but which requires that the bubbles be broken up either mechanically, or with a suitable anti-foaming reagent additive.
- mixing of high viscosity liquids involves more powerful energy consuming equipment.
- mixers for laboratories and industrial needs are structurally complicated and have sophisticated electronic control systems which are rather expensive.

SUMMARY OF THE INVENTION

The invented method has at least some of the following objectives:

To create a versatile and effective mixer for different types of liquids and mixing applications.

To provide a method for mixing in accordance with the foregoing, characterized by such positive features as: minimal formation of foam or bubbles during the mixing process, increase quality of mixing if mass of liquid to be mixed increases, instant mixing of whole volume of liquid.

To provide a method of the kind indicated, resulting in efficient mixing of liquids in large vessels.

To provide a method in accordance with the above, resulting in a simplified structure and controlling of processes, and thus, mixers of reduced production cost.

DETAILED DESCRIPTION OF THE PREFERRED EMBODIMENTS

The core principle of the invented mixing technology is steering of a vertically placed container with liquid or liquid with small particle substances to be mixed inside. Radial ribs extend upward from the bottom of the container. The ribs can be made integrally with the container, as one body, or separately and then firmly attached to the container's bottom such that rotation of the container is transferred to ribs at the same speed and mode.

Figure 27:
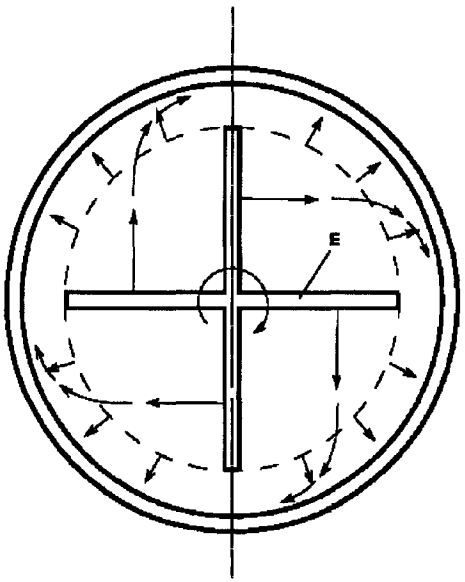
FIG. 27 is a scheme of movement of liquids to be mixed using apparatus of present invention. The horizontal section view.
Figure 26:
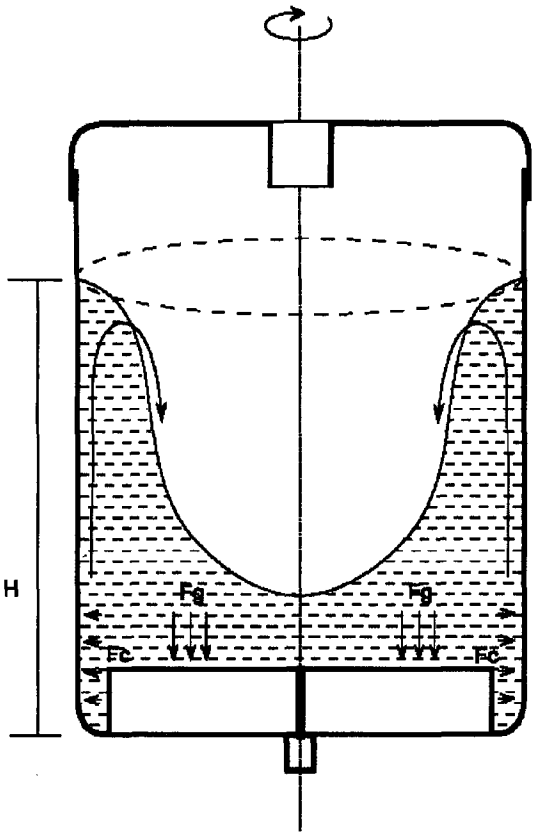
FIG. 26 is a scheme of liquids movement to be mixed using apparatus of present invention. The vertical section view.

Rotation of the container with ribs generates three types of forces applied to the liquids inside: centrifugal (Fc), gravity (Fg), and friction (Ff). In FIGS. 26,27 a schematic liquids hydrodynamics during the mixing process is shown. When the rotation of the container with liquids starts, the ribs together with the centrifugal force Fc push liquid from the triangle spaceween the ribs toward the container's wall. The space is being emptied instantly, and the liquid above the spaces drops down and fill the emptied spaces. This new portion of liquid is also pushed towards the wall and so on. This relocation of liquids generates their flow from central part of the container towards the wall.

Due to friction force Ff between the wall and the liquid, the latter gets the horizontal rotation about the wall. This rotation, in turn, generates centrifugal force Fc pressing the liquid against the wall. The higher the speed of rotation of the liquid, the larger the centrifugal force, the higher the pressure of liquids pushing against the wall, the larger the friction force that rotates the liquid horizontally, and the higher the speed of rotation of the liquid.

The centrifugal force Fc, not only increases friction force Ff but also pushes up the liquid along the wall. Due to centrifugal pressure the liquid at the wall goes upward and can reach the top of the wall. At the same time, gravity force Fg applied to the liquid acts in opposite direction. At some point the gravity force overwhelms the force elevating the liquid. Then the liquid drops down back into the spaces between ribs at the bottom. Dropped liquid is pushed toward the wall and goes upward due to Fc once again, repeating the cycle. A wall to wall whirlpool appears at the central part of the container. As a result, liquid gets directed in a 3D motion in the horizontal and vertical planes, producing some of the extraordinary features of the mixer.

As it was shown by tests, if the speed of steering is 500-600 rpm or more, relocation of the central part of the liquid body inside the container toward the wall is made in a fraction of a second. Accordingly, the whirlpool's bottom goes downward until it reaches the bottom of the container and finally, the liquid takes the form of a sleeve around the wall. Contacting surface between the liquids and the container's wall is maximized, and intensity of the mixing increases dramatically. What is also important, mixing of whole volume of the liquids begins instantly and appears explosive-like, causing intensive mixing of liquids at relatively low speeds of liquid's driver (500-600 rpm).

As it was described, the centrifugal force Fg pressing the liquids toward the wall and generating the friction force between the liquid and the wall, determines the intensity of mixing process—as centrifugal force increases, friction force between the liquid and container's wall also increases. It creates still another unusual feature of the invented mixer: the bigger the diameter of mixing container, the larger the centrifugal force Fc, and the more intensive mixing process. This feature is especially important for mixing liquids in bulk, and in contrast with any of the existing mixing methods, where increase in diameter of the container decreases intensity of mixing.

In some applications, the efficiency of the method can be intensified by attachments comprising of a mesh placed across liquid's flow. Such attachments are especially effective, for example, for dissolving of solid particles in liquid and preparation of extracts. Liquid flow presses the particles against the mesh but they cannot go through. In contrast, power flow of liquids runs through the mesh contacting with particles on its way. It effectively enforces the above processes.

Other effective applications of mixers with mesh are mixing of high viscosity liquids or preparation of emulsions. Powerful flow of liquids running through the mesh is being disrupted into smallest drops, and become full-section of flow after the mesh. The number of such disruptions and restorations of liquid flow is tens of thousands per min. The mixer with mesh is in high shear.

As it is clear, a combination of basic container with mesh attachments convert the mixer into an universal mixing combine.

The following advantages of the invented method have been revealed:

easy mixing of both: low or high viscosity liquids;

no foam or bubbles during the mixing process;

instant vigorous mixing at low speed of driving means;

intensive mixing with larger quantity of liquids being mixed;

no contact between liquids and mixing driver;

operation of mixing processes is provided by controlling of spinning of the container only.

Summarizing the above, it should be stated that the invented method is conceptually different from the prior art. Design of existing mixers is based on moving of the liquids to be mixed about a stationary container, whereas in the invented method the movement of liquid is created by spinning the mixing container. Liquid in the container gets impelled along all three directions and intensive mixing is accomplished due to friction force, centrifugal force and gravity force applied to the liquids.

A structure of the invented mixer in different structural versions in preferred embodiment is shown in FIGS. 1-25. In this description two main ways of application of the mixers are considered:

1. Laboratory Mixers.

Figure 1:
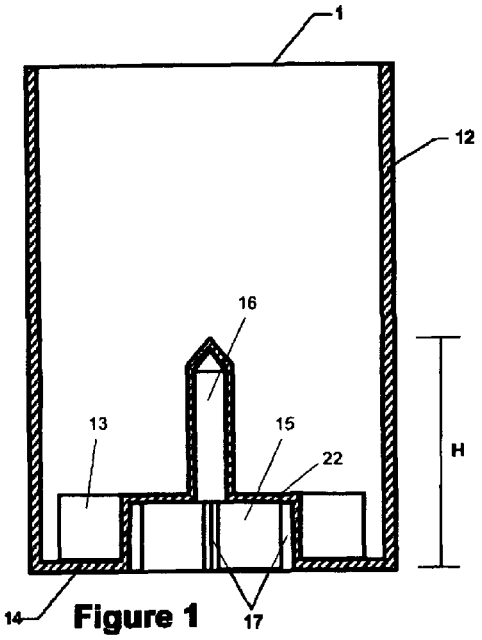
FIG. 1 is a vertical section view of a mixing laboratory apparatus adapted to practice the method of the present invention.
Figure 2:
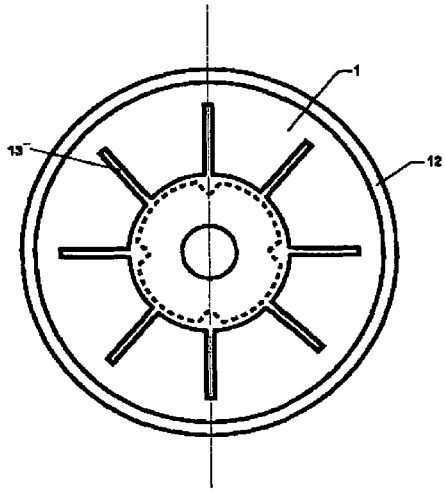
FIG. 2 is a top plan view of the apparatus of FIG. 1.
Figure 3:
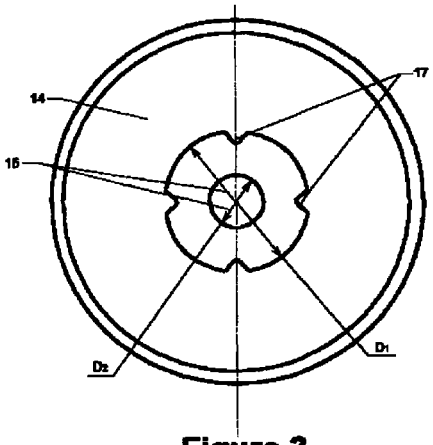
FIG. 3 is a bottom view of the apparatus of FIG. 1.
Figure 4:
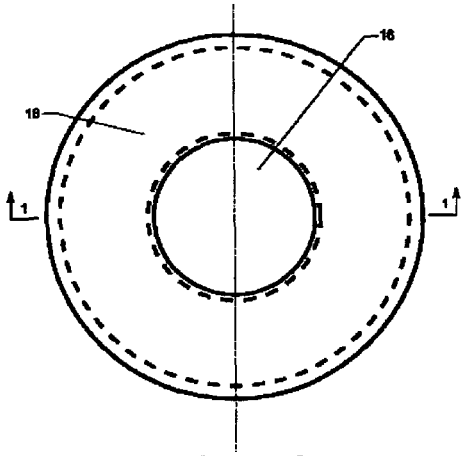
FIG. 4 is a top plan view of a cover for the apparatus of FIG. 1.
Figure 5:
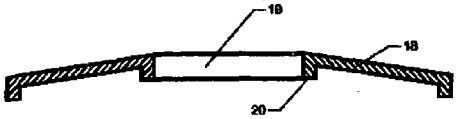
FIG. 5 is a vertical section view of a cover for the apparatus of FIG. 1.

The mixers consist of a container of up to 10 liters volume, in which the liquids to be mixed are located, a driver for stirring the container with a coupling mechanism connecting the driver and the container, a housing, and an operating control unit. The container is a metal or plastic canister of cylindrical shape, or beakers used conventionally for laboratory applications, or flasks, adapted to the invented mixing method. FIGS. 1-5 show a preferred embodiment of the mixer with a container having cylindrical wall. The main parts of container 1 include: wall 12 and the first set of ribs 13 extending upward from the bottom 14 of the container. In the presented embodiment, the number of ribs is eight, but it may be more or less. As shown, the ribs 13 are made integrally with the container at its bottom. Based on data from the experiments, the height of the ribs above the bottom should be about $1/10^{th}$-$1/12^{th}$ of the container height. The container has the female coupling mechanism 15 providing male/female connection of the container to the driver, for transferring the driver shaft's rotational motion to the container. The coupling mechanism 15 is combined structurally with the ribs 13 as shown in FIGS. 1,2. The mechanism comprises of: a tube-like chamber 16, protruding inside of the container, designed to fit the male component of the mechanism extending from the driver (see below). Height H and diameters D1 and D2 of chamber 16 should provide reliable connection between the container and the driver, without wobbling and shifting the container during mixing process. Teeth 17 inside chamber 16 transfer rotation of the male component of the coupling from driver to the container.

Container's lid 18 (FIGS. 4,5) prevents the liquids from spilling out during the mixing process. The lid can be separated from the container, as shown in the presented embodiment, or integrated with it in one body. In first case the lid has a means for liquid-tight connection with the container withstanding pressure of liquid generated inside the container when the mixer is in use. At the top of the lid 18 is an opening 19 for loading liquids into the container. Based on experiments, the diameter of the opening should be about 0.5-6 times the diameter of the lid. Rim 20 around the opening, facing inside of the container is desirable.

As a structure to be rotated, the container as it is and with the lid must be well balanced to eliminate twisting during the mixer's operation.

Figure 6:
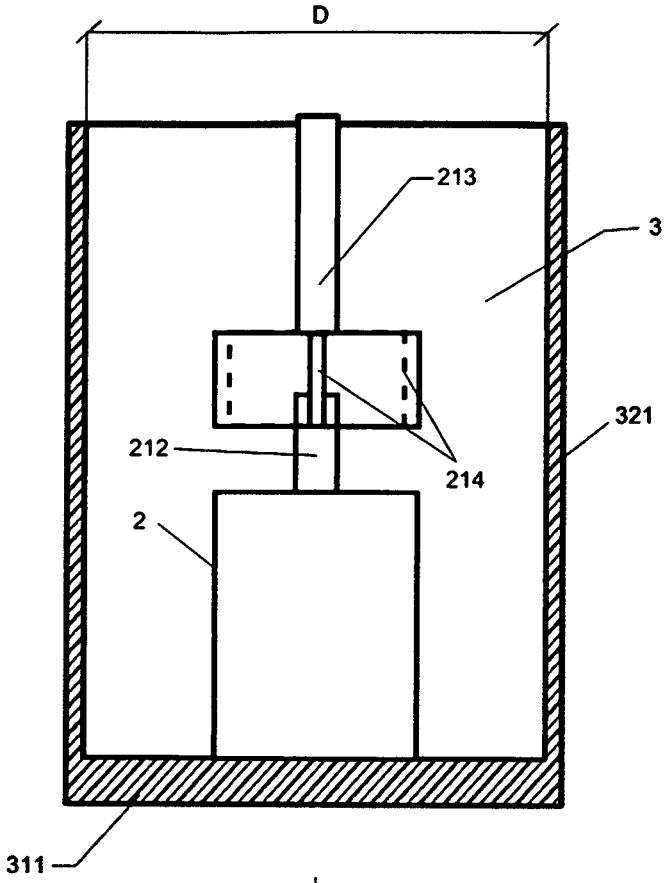
FIG. 6 is a vertical section view of a base for the mixing laboratory apparatus of FIG. 1.
Figure 7:
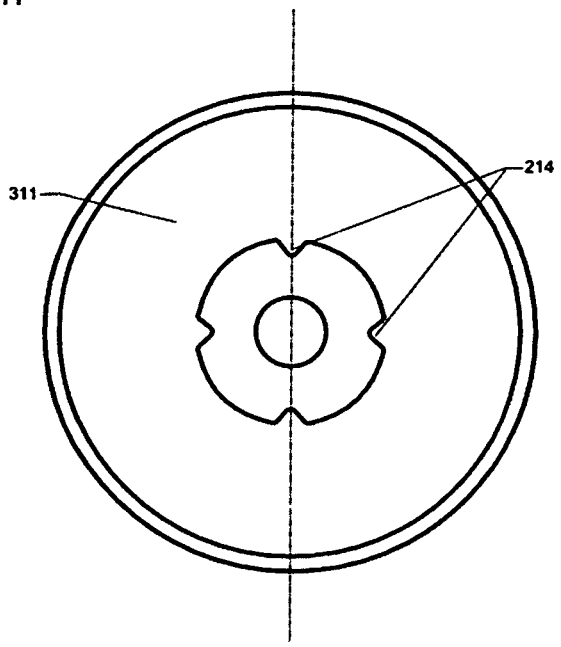
FIG. 7 is a top plan view of the base of FIG. 6.
Figure 8:
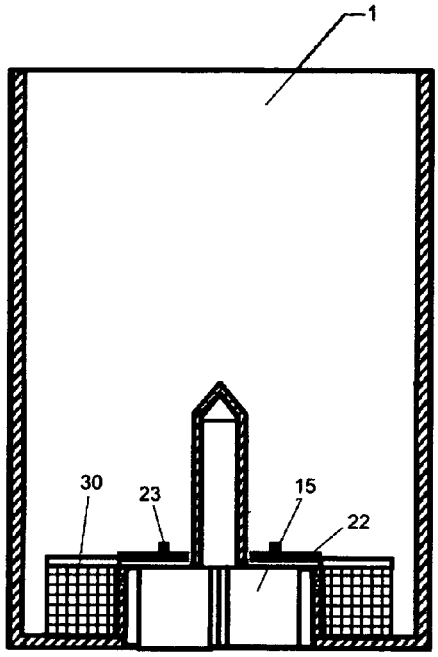
FIG. 8 is a vertical section view of a mixing laboratory apparatus, with meshed ribs at the bottom.
Figure 10:
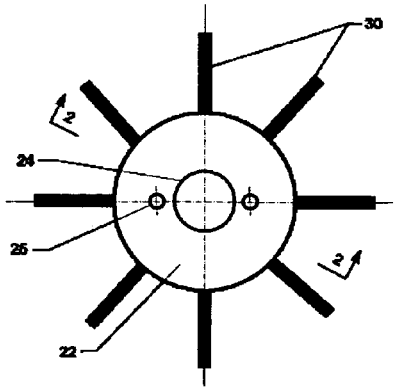
FIG. 10 is a top plan view of an attachment with meshed ribs for the apparatus of FIG. 8.
Figure 9:
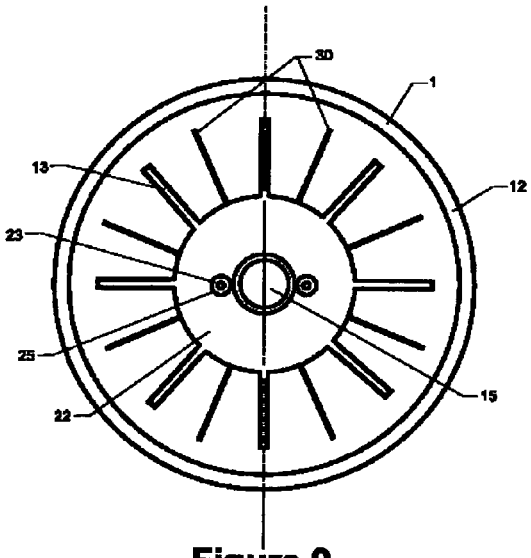
FIG. 9 is a top plan view of the apparatus of FIG. 8.
Figure 11:
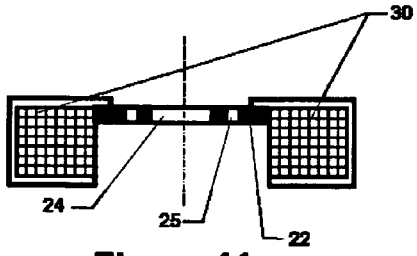
FIG. 11 is a vertical section view of the attachment with meshed ribs of FIG. 8.
Figure 12:
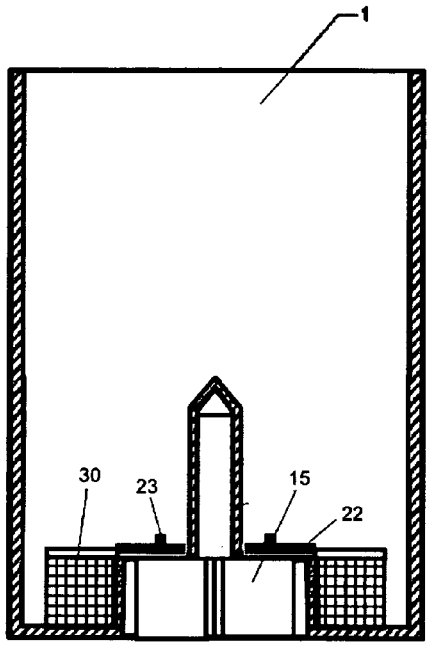
FIG. 12 is a vertical section view of a mixing laboratory apparatus with circular meshed attachment at the bottom.
Figure 13:
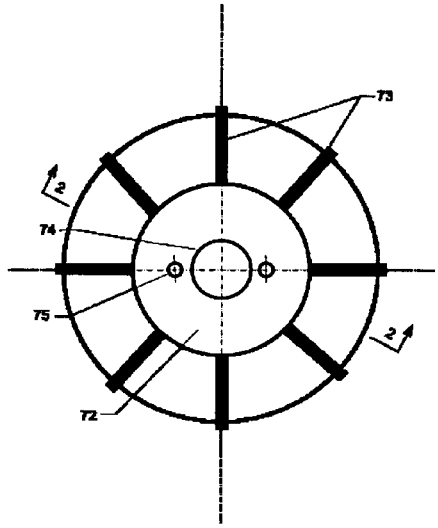
FIG. 13 is a top plan view of the circular meshed attachment of FIG. 12.
Figure 14:
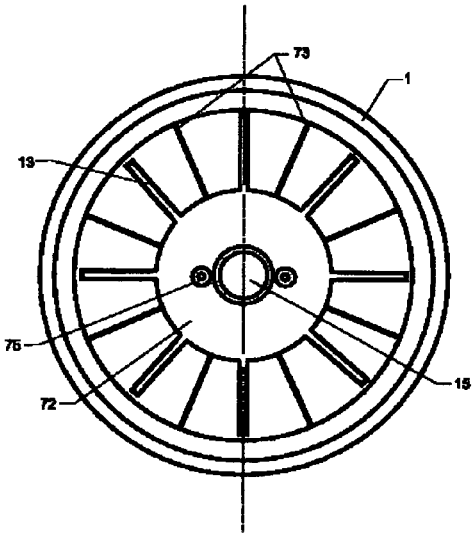
FIG. 14 is a top plan view of the circular meshed attachment of FIG. 12.
Figure 15:
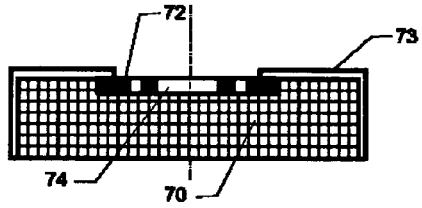
FIG. 15 is a vertical section view of the circular meshed attachment of FIG. 14.

Driving mechanism 2 and housing 3 are shown in FIGS. 6,7. The driving mechanism includes a reversible electric motor 211 capable of rotating the container with liquid. Motor shaft 212 extends toward the container. Male component 213 of male/female connection between the motor shaft and the container is attached to the shaft. It is designed to fit the female components 15 and 16 on the container. Component 213 includes slots 214 designed to align and mesh with teeth 17. Such meshing should be tight enough to provide reliable transfer of motor rotation to the container, without shocks at the beginning of mixer's operation and when the mode of rotation of the motor is changed.

Speed, direction and protocol of motor rotation are controlled by operating means. The liquid flow inside the container may be smooth and laminar at slow speeds or turbulent and very intensive at high speed. At given speed the intensity of mixing depends on mode of rotation of the container: slowest at one way rotation, moderate at run-stop-run mode, and highest at clockwise-counterclockwise mode. Speed and mode of rotation determine mixing protocol during laboratory tests.

Housing 3 is a cylinder comprising of bottom 311 and walls 321. Electric motor 211 is attached to the bottom 311 by any convenient way. Walls 321 are made for safety and to protect the operator from damage when the mixer is in use. The housing is made of heavy weight material, for example, cast iron, to prevent rocking of the mixer if imbalanced loads are applied. Diameter D provides convenient placement of cylinder 1 inside the housing.

Flasks and beakers of regular shapes should be modified for the invented mixing technology. Compared with the container 1 with cylindrical wall described above, new parts should be added to both beakers and flasks for use with the mixer. These parts are vertical ribs at the bottoms and a means for male/female connection between beaker or flask and driving motor. Beakers should have also a watertight lid. The design of the new parts can be the same as described for cylindrical container.

The second version of the invented mixer is a container as described above with a second set of meshed ribs placed at the container's bottom (FIGS. 8-11). The main difference between this version compared to the one described above is this additional attachment: a metal disc 22 with vertical meshed ribs 30 at its periphery. Metal disc 22 with a center hole 24 rests on the lower part of female part of coupling mechanism 15. Pins 23 extend upward from female part for coupling together with two holes 25 in disk 22. It prevents rotation of the attachment about female coupling when the mixer works. Vertically placed meshed ribs 30 are attached to disk 22 in the way shown in FIGS. 8,9. The meshed ribs 30 are located between solid ribs 13.

As a sub-version of the second version, one can consider an attachment with circular mesh overlapping the ribs 13 (FIGS. 12,13,14,15). In described preferred embodiment, metal disk 72 with consoles 73 carry mesh 70. Diameter of said disk with said consoles is bigger than diameter of female coupling 15 with ribs 13. Shear effect of the attachment is accomplished when the flow of liquid created by ribs 13 and the centrifugal force is pushed through the mesh. The attachment is affixed to the container the same way as described for the second version of the invention.

Figure 16:
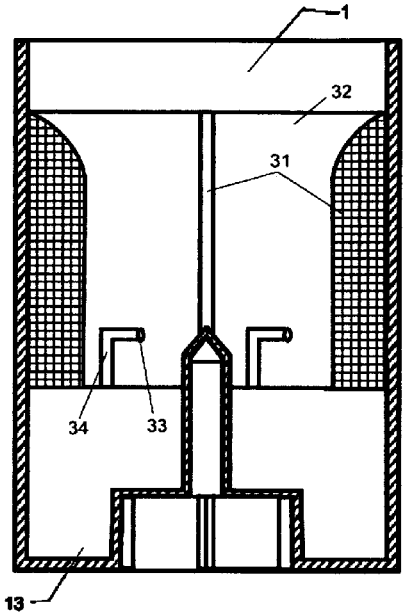
FIG. 16 is a vertical section view of a mixing laboratory apparatus, with vertical meshed attachment at wall.
Figure 17:
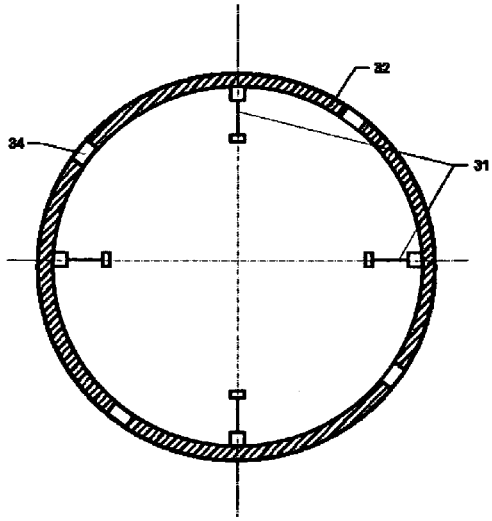
FIG. 17 is a top plan view of the apparatus of FIG. 16.

In case of mixing of high viscosity liquids or preparation of emulsions, the processes can be effectively enforced if meshed ribs are installed at the wall of the container. The container with wall attachment is the third structural version of the invention. As shown in FIGS. 16-17, in preferred embodiment, vertical meshed ribs 31 are located in central part of container's wall. As is revealed from experiments, the most intensive horizontal flow of liquids in mixing process according to the invented method is just along this part of the container. Ribs 31 are attached to a sleeve 32 which is to be inserted and can be removed from the container. Pins 33 extending from container's wall 12 provide vertical support for sleeve 32. Opening 34 in the sleeve prevents vertical movement of the sleeve when the mixer operates.

Figure 18:
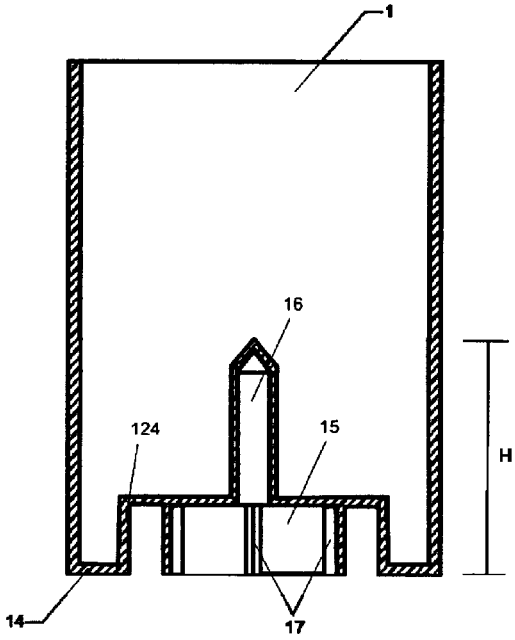
FIG. 18 is a vertical section view of a mixing laboratory apparatus, with solid element at a bottom, instead for ribs in FIG. 1.
Figure 19:
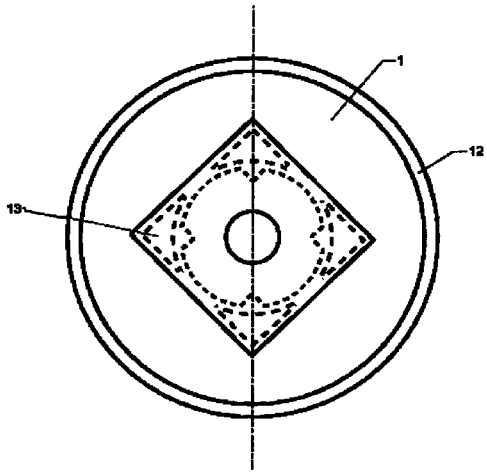
FIG. 19 is a top plan view of the apparatus of 18.
Figure 20:
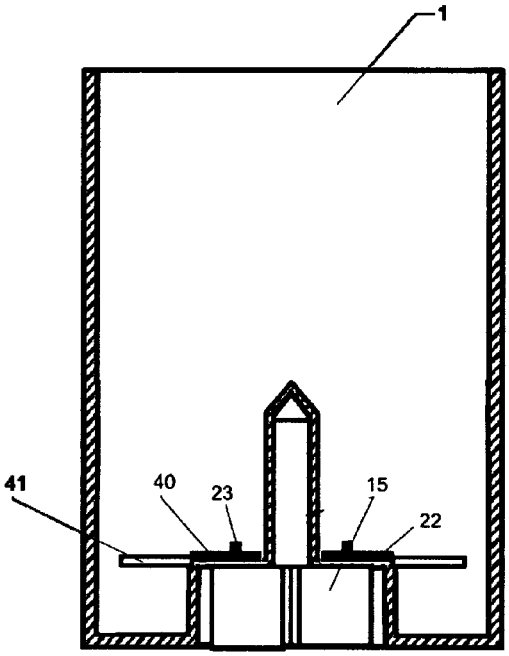
FIG. 20 is a vertical section view of a milling laboratory apparatus, with knife attachment.
Figure 21:
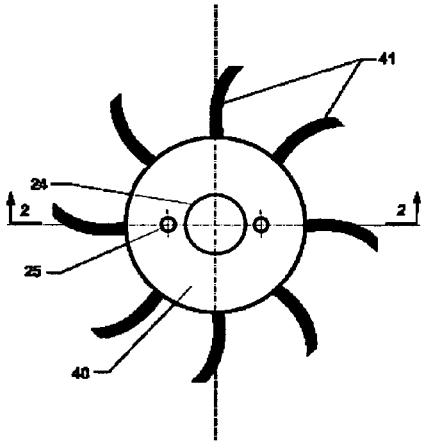
FIG. 21 is a top plan view of the apparatus of FIG. 20.
Figure 22:
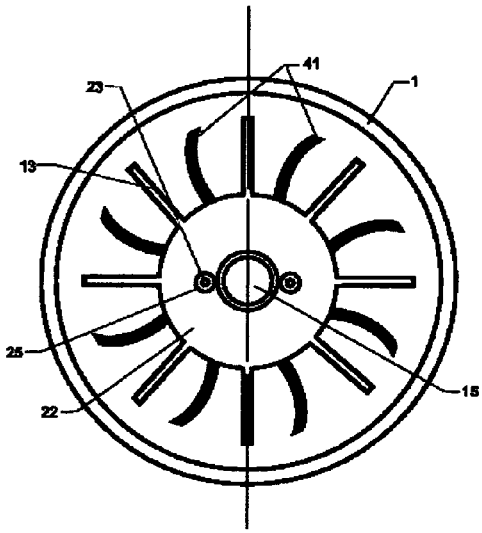
FIG. 22 is a top plan view of the knife attachment of FIG. 20.
Figure 23:
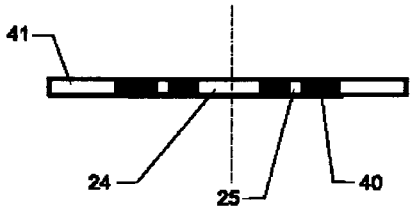
FIG. 23 is a vertical section view of the knife attachment of FIG. 22.

The fourth structural version of the container is intended for mixing of foam-forming substances. The structure includes an element substituting ribs 13 at the bottom of the container, as shown in FIGS. 18,19. Actually, ribs 13 are integrated in one solid body 124. Similar to ribs 13, the body propels liquids toward the walls when the container is rotated, however, in contrast to ribs, it does so with minimal and gentle contacts with the liquid. Such contacts prevents forming foams during mixing process. At the same time, centrifugal force pressing liquid toward the wall exclude formation of bubbles. In the preferred embodiment the body 124 is of square shape, but may be different.

The fifth structural version of the container is intended for milling liquids with pulp or suspended solid particles. For this purpose, the attachment 40 is similar to those with meshed ribs in the first structural version (FIGS. 20-23). The difference is that ribs 30 are substituted by sharp knives 41. During rotation of the container the knives cut the downstream flow with the product to be milled, which is dropping from the top to the container's bottom. As speed of rotation of the knives is high, milling of the products is effective.

As follows from the above description of the invention, a mixer comprising of a basic canister according to version one of the invention, and a set of attachments according to versions two, three, four and five is actually a universal mixing combine, performing a variety of processes of mixing liquids as well as liquids and solids.

As it is clear, the combine can include more than one container rotated by one motor, with proper systems for transfer of motor rotation to a number of containers.

One should not exclude usage of the invention for mixing of fine, non-sticky solid particles.

2. Industrial Mixers.

Figure 24:
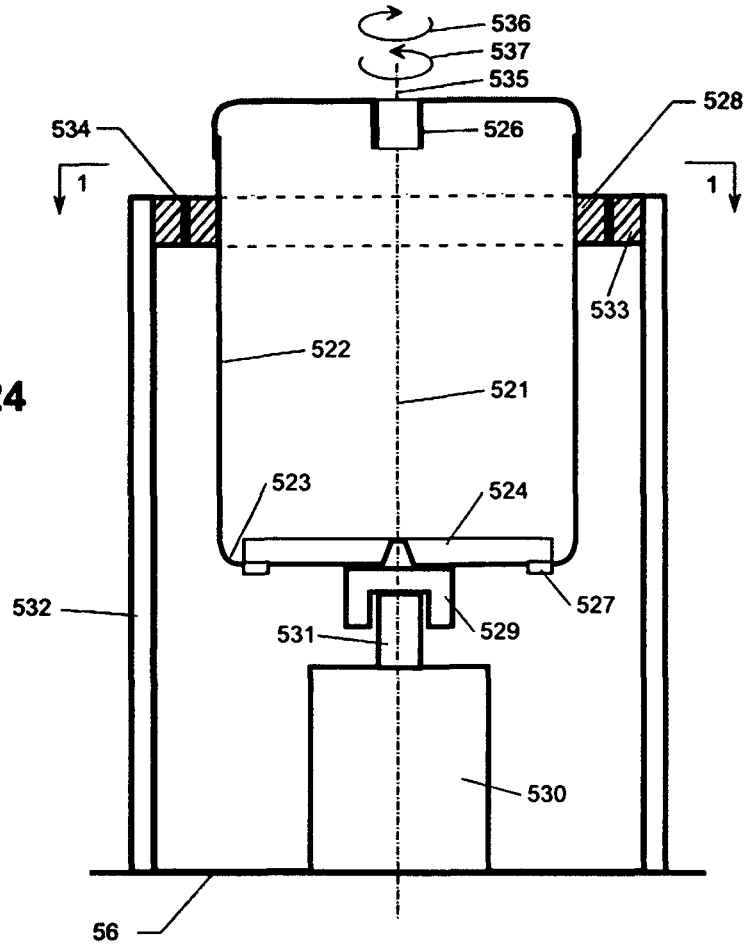
FIG. 24 is a vertical section view of an industrial mixing apparatus adapted to practice the method of the present invention.
Figure 25:
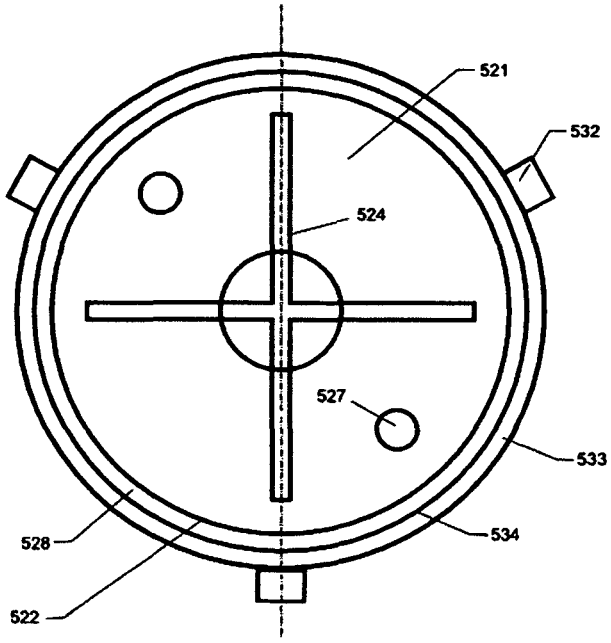
FIG. 25 is section view of the apparatus of FIG. 24 along 1-1.

Referring now to FIGS. 24,25, are illustrated an apparatus for industrial mixing of liquids in bulk. Metal tank 521, having side walls 522 and bottom 523 is used as a container for liquids to be mixed. The top is fitted with a suitable removable cover 525. The latter has an inlet opening 526, and the bottom wall 523 of the tank has one or more outlet openings 527 (shown schematically), for withdrawing the liquid.

Tank 521 is supported on a combined turntable and coupling member 529, which is in turn carried on the shaft 531 of a motor 530.

The entire mechanism is preferably surrounded by a housing on the floor 56. The housing has side columns 532, and near the top, a bearing and sleeve 528, 533, 534 which provide lateral stability to the tank 521 when imbalanced loads are applied from inside. For safety reasons the mixer should have a surrounding fence (not shown).

Finally, in accordance with the method of the invention, bottom 523 of tank 521 has rib element 524.

In the preferred embodiment, in order to attach the tank 521, the ribs 524 in the bottom 523 thereof are hollow, and a vertical projection on the coupling member 529 extends into the hollow portion of the ribs 524 and thereby supports the bottom 523. As is clear, other coupling means connecting the tank with motor shaft 531 can be applied.

The tank is intended for solely rotation about vertical axis 535, as indicated by the two arrows 536, 537 in FIG. 24. Rotation in each of the two opposite directions is contemplated.

As is clear, depending on application, the industrial mixer can be supplied with the attachments similar to those described for the laboratory mixers, or can have such attachments fixed permanently to bottom or wall of mixer's tank.

The objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

The embodiments of the invention in which an exclusive property of privilege is claimed are defined as follows:

1. A method of mixing liquids, or mixing a liquid with solid particles, comprising:

providing a container, wherein said container is selected from a group consisting of substantially cylindrical vessels, canisters, flasks or beakers, and wherein said container comprises a wall, comprised of a bottom, a side and a top and a first set of radial ribs disposed at said bottom of said wall of said container;

providing said first set of radial ribs where the vertical height of said radial ribs, disposed at said bottom of said wall of said container, does not exceed one-tenth of the vertical height of said container;

providing a frame with an electric motor, wherein said electric motor is rotatedly coupled to said container wherein said electric motor rotates the entire container when energized;

loading contents into said container, wherein said contents comprise said liquids or said liquids with said solid particles;

energizing the electric motor; effecting a movement of said contents within said container by movement of the entire container, comprising:

generating centrifugal force caused by said rotation of said contents within said container, wherein said centrifugal force forces said contents against said side of said wall of said container and causes a friction force between said contents and said side of said wall of said container, wherein said centrifugal force forces said contents within said container to move upward along said side of said wall of said container towards said top of said wall, and wherein said contents drop downward from said top of said wall of said container onto said bottom of said wall of said container by gravitational force; and repeating said forcing of said contents against said side of said wall of said container, said upward movement of said contents along side of said wall of said container, and said downward movement of said contents towards said bottom of said wall of said container; thereby mixing said liquids or mixing said liquids and said solid particles to a desired degree.

2. The invention as set forth in claim 1, wherein length and shape of said radial ribs is adaptable to push said contents within said container against said side of said wall of said container, when the container is rotated clockwise, or counterclockwise, or reversibly clockwise and counterclockwise.

3. The invention as set forth in claim 2, wherein said first set of radial ribs are located symmetrically about an axis of rotation of said container.

4. The invention as set forth in claim 2, wherein said first set of radial ribs are integrated with the said bottom of said wall of said container and separated from said side of said wall of said container.

5. The invention as set forth in claim 4, wherein one or more meshed attachment is integrated with said bottom of said wall of said container and located between said first set of radial ribs.

6. The invention as set forth in claim 4, wherein said container comprises one or more meshed attachment disposed substantially perpendicular to direction of flow of said contents within said container during a mixing process.

7. The invention as set forth in claim 6, wherein said meshed attachment comprises a second set of ribs, located between said ribs of said first set of radial ribs, and wherein rib of the second set is disposed between two ribs of the first set.

8. The invention as set forth in claim 7, wherein said ribs of said second set of ribs are located symmetrically about the axis of rotation of said container.

9. The invention as set forth in claim 8, wherein said ribs of said second set of ribs are removable.

10. The invention as set forth in claim 6, wherein said one or more meshed attachment comprises a meshed wall overlapping said first set of ribs.

11. The invention as set forth in claim 10, wherein said one or more attachment is removable.

12. The invention as set forth in claim 6, wherein said attachments are disposed along said side of said wall of said container.

13. The invention as set forth in claim 12, wherein said meshed attachments are located symmetrically about the axis of rotation of said container.

14. The invention as set forth in claim 13, wherein one or more attachments is removable.

15. The invention as set forth in claim 4, wherein one or more knife is coupled to said first set of radial ribs.

16. The invention as set forth in claim 15, wherein a plurality of knives are located symmetrically about the axis of said container.

17. The invention as set forth in claim 16, wherein said plurality of knives are removable.

18. The invention as set forth in claim 2, wherein said radial ribs are integrated into a solid body of a substantially square or polygonal shape.

19. The invention as set forth in claim 1, wherein said electric motor is reversible, and wherein a speed of rotation is variable.

20. The invention as set forth in claim 1, wherein said container has means for loading said container with said contents to be mixed, and discharging the mixed substance, wherein said loading and discharging means is accomplished without stopping said rotation of the container.

* * * * *